US007032898B2

(12) United States Patent
Silberbauer

(10) Patent No.: US 7,032,898 B2
(45) Date of Patent: Apr. 25, 2006

(54) WIRE-STITCHING APPARATUS FOR PRODUCING WIRE STITCHED PRINT ITEMS

(75) Inventor: Günther Silberbauer, Uerkheim (CH)

(73) Assignee: Muller Martini Holding AG, Hergiswil (CH)

( * ) Notice: Subject to any disclaimer, the term of this patent is extended or adjusted under 35 U.S.C. 154(b) by 22 days.

(21) Appl. No.: 10/714,671

(22) Filed: Nov. 18, 2003

(65) Prior Publication Data

US 2004/0094883 A1 May 20, 2004

(30) Foreign Application Priority Data

Nov. 18, 2002 (EP) ..... 02405987

(51) Int. Cl.
*B65H 45/00* (2006.01)

(52) U.S. Cl. ..... 270/52.18; 270/52.26; 270/52.29

(58) Field of Classification Search ..... 270/52.18, 270/52.26, 52.29; 227/84, 2
See application file for complete search history.

(56) References Cited

U.S. PATENT DOCUMENTS 3,848,790 A * 11/1974 Verwey et al. ..... 227/90
4,236,706 A * 12/1980 Schlough ..... 270/52.18
4,356,947 A * 11/1982 Marshall et al. ..... 227/5
4,358,040 A * 11/1982 Stokes ..... 227/5
4,519,599 A * 5/1985 Mayer ..... 270/52.18
4,614,290 A * 9/1986 Boss ..... 227/1
5,772,195 A 6/1998 Mueller
5,788,139 A * 8/1998 Sikora ..... 227/82
5,938,388 A * 8/1999 Bloser et al. ..... 412/1
6,119,911 A * 9/2000 Funk et al. ..... 227/88
6,142,353 A 11/2000 Boss et al.
6,142,354 A * 11/2000 Boss et al. ..... 227/100

FOREIGN PATENT DOCUMENTS

CH 549443 A * 5/1974
DE 197 12 863 A1 10/1998

OTHER PUBLICATIONS

Tempo: Saddle Stitching System for Efficient Magazine and Catalog Production, Müller Martini, Switzerland/Tempo 410/9708/RI/E.

* cited by examiner

*Primary Examiner*—Patrick Mackey
(74) *Attorney, Agent, or Firm*—Venable LLP; Robert Kinberg; Steven J. Schwartz

(57) ABSTRACT

A wire-stitching apparatus for producing wire-stitched print items includes a conveying arrangement for supplying folded, printed products in a straddling position; a wire-stitching unit installed at an adjustable distance above the conveying arrangement and including a bending device; at least one wire-stitching aggregate; and a stitching carriage for moving the at least one wire-stitching aggregate back and forth along a path. The wire-stitching aggregate includes a bender for forming legs of a staple and a driver for pushing the staple legs through the printed products. At least one wire feed feeds wire to the one wire-stitching aggregate at a stitching wire length. At least one adjustable wire-cutting device for adapts a wire staple to the thickness of the printed products. A control unit measures the thickness of the printed products positioned on the conveying arrangement upstream of the wire-stitching unit, and/or processes stored data related to the printed products.

13 Claims, 7 Drawing Sheets

Fig. 5
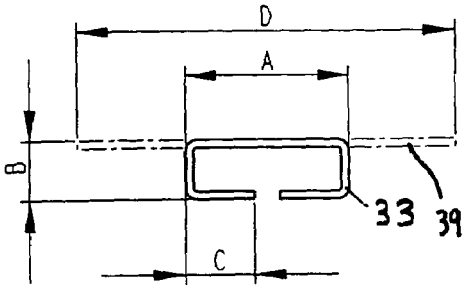
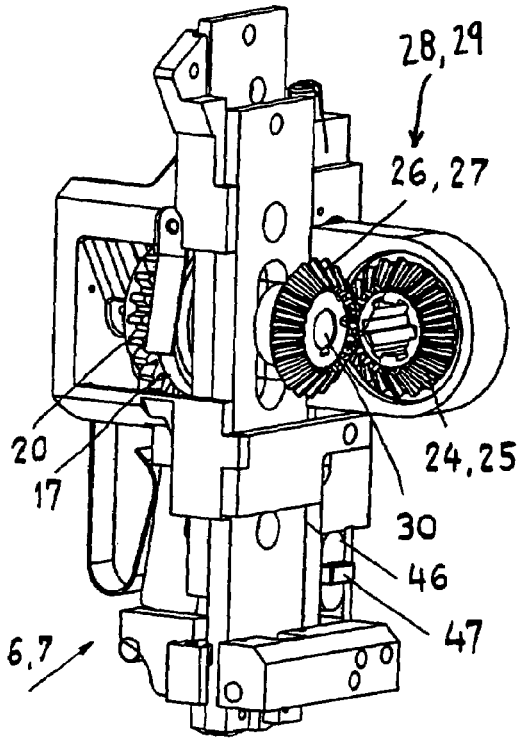
Fig. 6
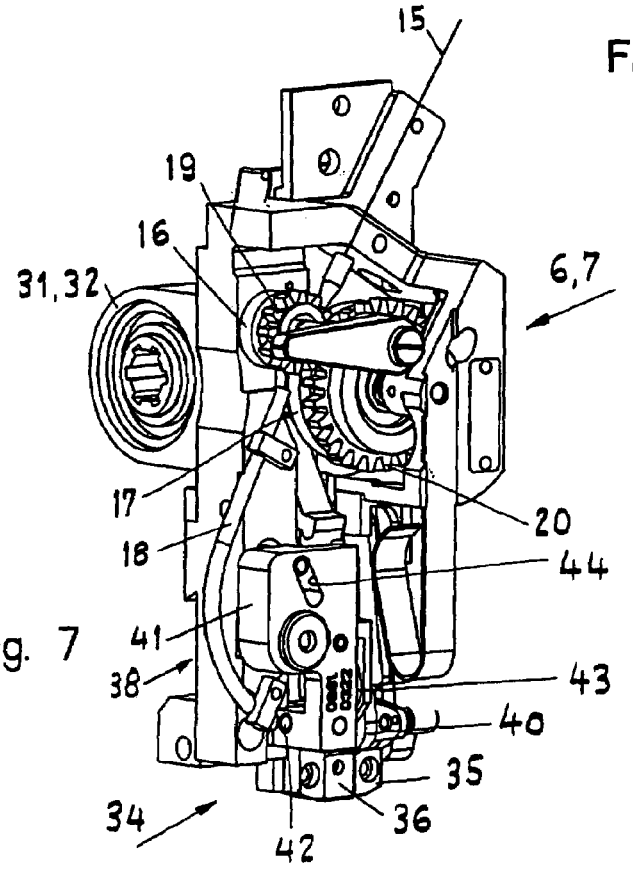
Fig. 7

22
F

WIRE-STITCHING APPARATUS FOR PRODUCING WIRE STITCHED PRINT ITEMS

CROSS-REFERENCE TO RELATED APPLICATION

This application claims the priority of European Patent Application No. 02405987.5-2304 filed on Nov. 18, 2002, the disclosure of which is incorporated herein by reference.

BACKGROUND OF THE INVENTION

The present invention relates to a wire-stitching apparatus for producing wire stitched print items from printed products.

Wire-stitching apparatuses of this type are known, for example, from gathering and wire-stitching machines in which different types of printed products are gathered in a gathering section to form a single print item that is subsequently stitched along a fold.

In one such wire-stitching apparatus, known as "Tempo" and shown in the Müller Martini brochure 410/9708, the printed products gathered on a conveying arrangement are wire-stitched by a wire-stitching unit while the products are being transported.

In an alternate gathering and wire-stitching apparatus that operates according to a similar wire-stitching principle, the printed products are transported by a conveying arrangement to a stationary wire-stitching position and stitched before being conveyed away.

In a drum-type gathering and wire-stitching apparatus, printed products are conveyed on a drum rotating around a horizontal axis and are subsequently stitched while in a stationary position on the rotating drum with the aid of a stitching unit.

SUMMARY OF THE INVENTION

It is one object of the present invention to create a wire-stitching unit that is suitable for producing stitched print items of varying thickness at high degree of reliability, but without requiring manual adjustment for devices on a wire-stitching apparatus and without reducing high production output.

This and other objects are solved according to the present invention in which a wire-stitching apparatus includes a conveying arrangement for supplying folded, printed products in a straddling position; a wire-stitching unit installed at an adjustable distance above the conveying arrangement and including a bending device; at least one wire-stitching aggregate; and a stitching carriage for moving the at least one wire-stitching aggregate back and forth along a path. The wire-stitching aggregate includes a bender for forming legs of a staple and a driver for pushing the staple legs through the printed products. At least one wire feed feeds wire to the wire-stitching aggregate at a stitching wire length. At least one adjustable wire-cutting device forms a wire staple in dependence on the thickness of the printed products. A control unit performs at least one of the following functions: 1) measuring the thickness of the printed products on the conveying arrangement upstream of the wire-stitching unit, and 2) processing stored data related to the printed products.

The wire-stitching unit adjusting mechanism includes at least one locally fixed means for driving the adjustment of the connected to the control unit.

A mechanism for adjusting the height of the conveying arrangement includes controllable, locally fixed means for driving the adjustment.

The wire feed is adjustable to the thickness of the printed products, and the mechanism for adjusting the wire feed includes a driver for driving the adjustment, a drive shaft extending through the stitching carriage parallel, and at least one gear having at least one drive wheel displaceably mounted on the drive shaft and being assigned to the one stitching aggregate.

The wire feed can include two friction wheels for transporting the wire and a wheel arrangement driving the friction wheels.

The gear can be a miter gear.

The wire-cutting device can include a blade holder that can be adjusted to the thickness of printed products. The wire-cutting device adjusting mechanism includes a follower pin arranged on the blade holder that engages a guide track extending at a slant relative to the path of the stitching carriage and coupled via a height-adjustable guide rail to at least one torque-controlled electric motor.

The guide rail can include a guide member, and the wire-cutting device adjusting mechanism can further include drive cams arranged on the blade holders and a cam rail attached to the stitching carriage acting upon drive cams of the blade holders such that the cam rail can be driven back and forth inside the guide member of the guide rail.

The wire-cutting device can include an adjusting mechanism having a follower pin on the blade holder that engages in a guide track extending at a slant to the path of the stitching carriage and a lever arrangement connecting the guide track to a driver.

The driver of the guide track can include an electric motor, a shaft extending through the stitching carriage parallel to the path and connected to the electric motor, at least one lever connected to the shaft, a guide rod connected to the at least one lever, and a cam rail actuated by the guide rod.

The wire-stitching apparatus can further include a bending device that can also be adjusted to the thickness of the printed products. The bending device can include at least one bending block, an adjustable bending support supporting the at least one bending block, and a mechanism for adjusting the bending support. The bending support adjusting mechanism can include a gear, a drive shaft attached to the gear, and a locally fixed, torque-controlled electric motor for driving the drive shaft.

The bending support adjusting mechanism can further include a toothed segment drive-connected to the bending support, a stationary toothed rack that can be moved along with the toothed segment, and a lever arm arranged on the drive shaft of the electric motor and connected to the toothed segment.

The bending support adjusting mechanism can further include a shaft-hub connection extending through the stitching carriage for connecting the drive shaft to the lever arm. The shaft-hub connection can transmit torque when displaced by the drive shaft. The electric motor can be adapted to accommodate overload.

The conveying arrangement can also be adjustable to the thickness of the printed products and include a chain guide, at least one link chain circulating on the chain guide, and a roof-shaped support with individual members attached to the chain guide. The chain guide can include downwardly extending lifters, and conveying arrangement adjusting mechanism can include lever gears attached to a drive shaft.

The torque of the electric motor can be preset for operation. The drivers provided for the individual devices can are torque-controlled electric motors, and in the exemplary embodiment, the motors are servomotors.

The adjustment operations can occur simultaneously with other controlled resetting operations and/or adjustments. Adjustments can occur during the operation of the wire-stitching unit and/or a gathering and wire-stitching apparatus, or can take place either before or after a wire-stitching cycle.

BRIEF DESCRIPTION OF THE DRAWINGS

The invention is explained in the following with the aid of an exemplary embodiment and with reference to the drawings, to which we refer for all details not mentioned in the specification.

FIG. 5 shows a wire stitching staple.

FIG. 6 shows a rear view of the stitching aggregate.

FIG. 7 shows a front view of the stitching aggregate.

DETAILED DESCRIPTION OF THE INVENTION

Figure 1:
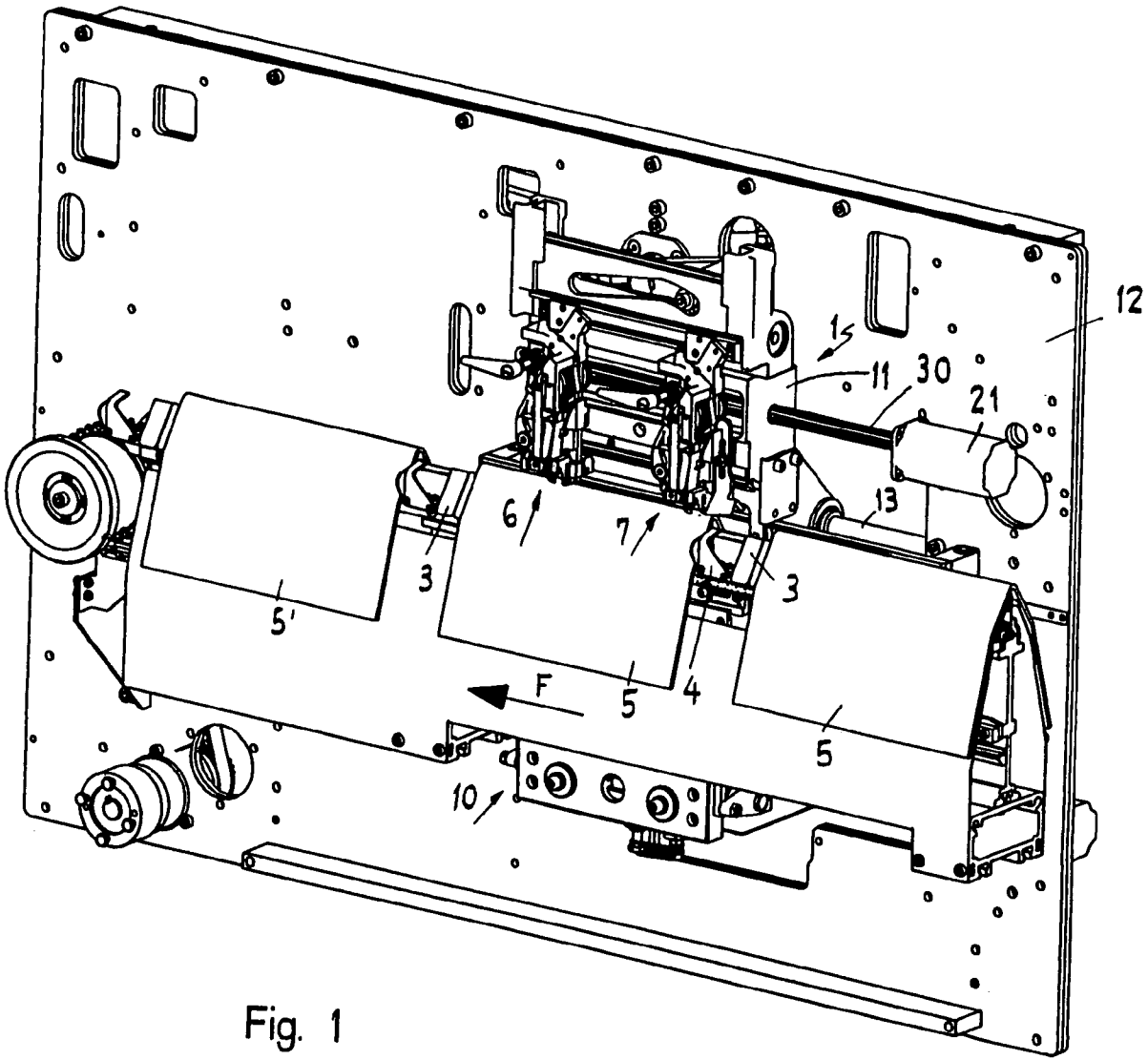
FIG. 1 shows a wire-stitching unit of a gathering and wire-stitching apparatus.
Figure 2:
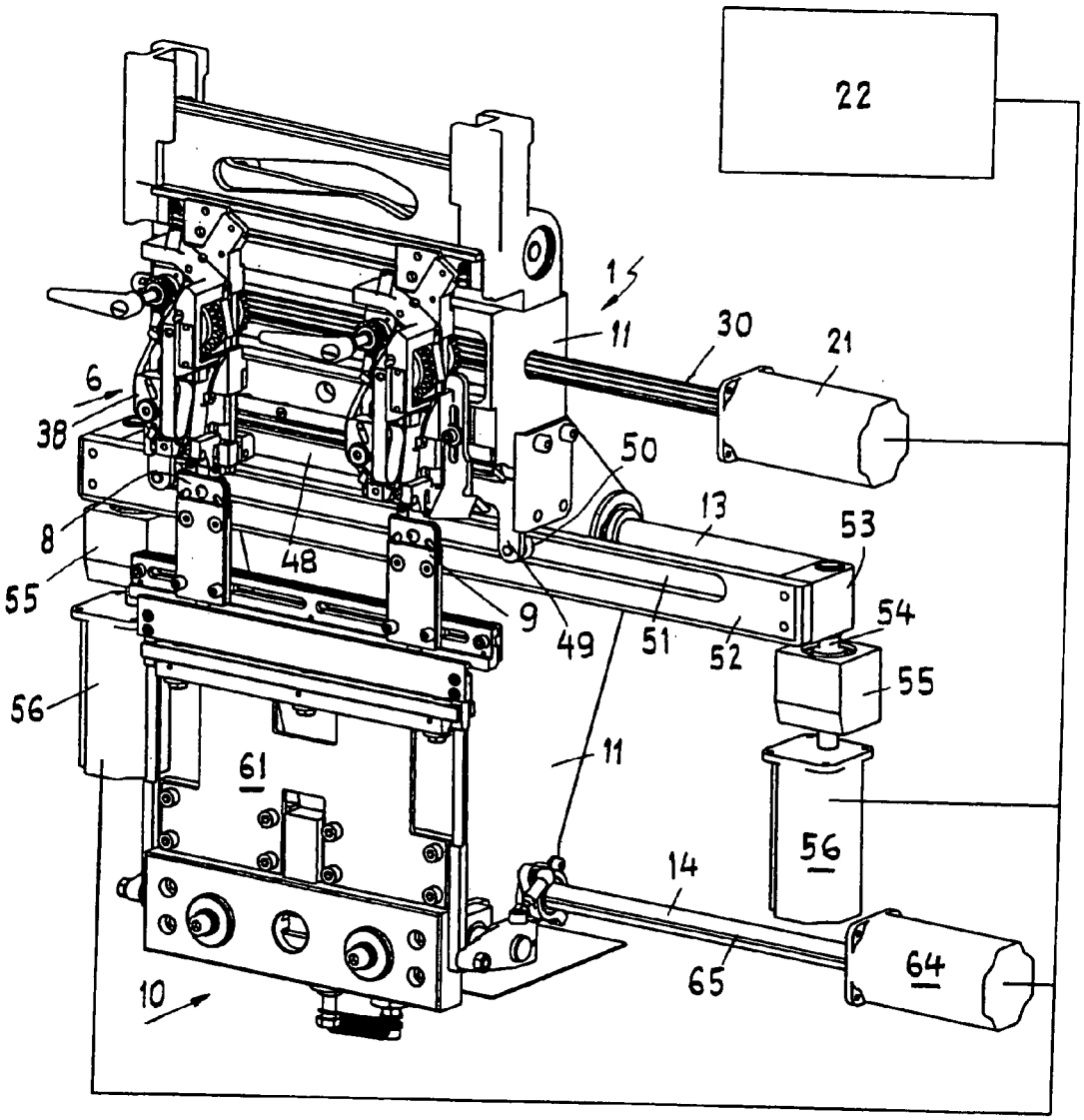
FIG. 2 shows another view of the stitching unit shown in FIG. 1.

Referring to the Figures, a gathering and wire-stitching apparatus includes a stitching unit 1 arranged on a conveying arrangement 2. Individual printed products or products gathered to form printed products 5 are positioned straddling on carriages 4 attached to a traction mechanism with saddle-shaped supports 3. The printed products 5 are conveyed on a conveying arrangement 2 in a conveying direction F to the stitching unit 1 traveling along with the conveying arrangement to stitch the printed products 5 along the fold. The stitching unit 1 includes two stitching aggregates 6, 7 and respectively one bending block 8, 9 of a bending device 10. The stitching aggregates 6, 7 and the bending device 10 are arranged on a stitching carriage 11 driven back and forth along the conveying device 2. The stitching unit 1 and conveying arrangement operate synchronously in the gathering and wire-stitching apparatus. The stitching carriage 11 is guided along two rods 13, 14 connected to a machine frame 12.

The operation of the stitching aggregates 6, 7 is described in Swiss Patent Document A-549 443, incorporated herein by reference, and is explained further herein within the framework of the present invention. Stitching wire 15 is fed to the stitching aggregates 6, 7 while clamped between two friction wheels 16, 17, via a wire guide 18, at a wire length that corresponds to the desired size of the wire staple. The friction wheels 16, 17 are driven by two gear wheels 19, 20 that mesh and are fixedly connected to the friction wheels 16, 17, as particularly shown in FIG. 7.

Figure 3:
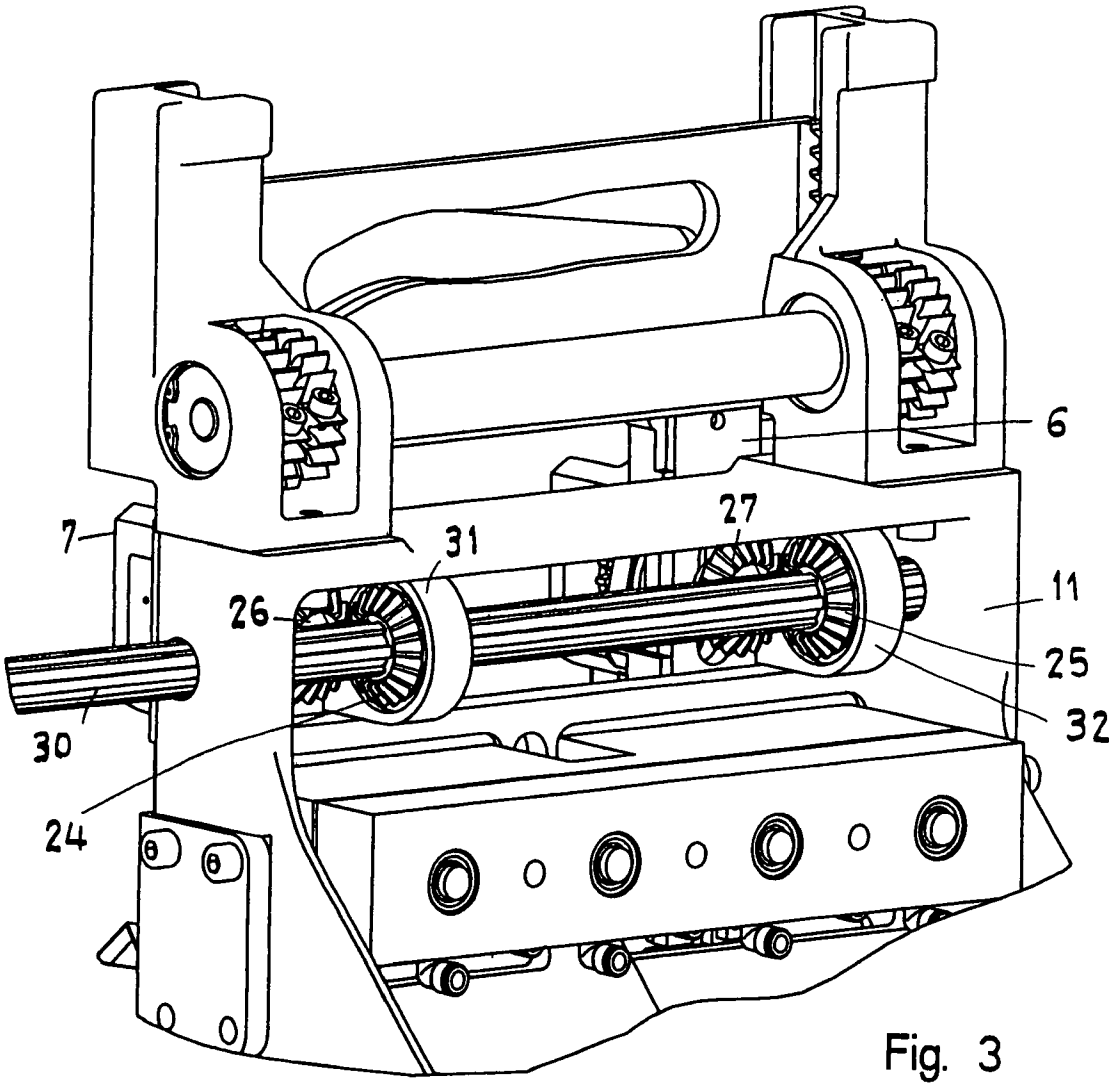
FIG. 3 shows a rear view of the stitching unit shown in FIG. 2.

A locally fixed, torque-controlled electric motor 21 varies the length of the wire segments for the staples. A finished staple is shown in FIG. 5. The electric motor 21 is coupled to at least one of the friction wheels 19, 20 and also to a control unit 22. This arrangement prevents wear and tear to the cables supplying energy to the electric motor 21, usually caused by the stitching unit 1 movements, due to the structural design of the stitching carriage 11 and the adjustment mechanism. The electric motor 21 can be connected to the machine frame 12, and a drive shaft 30 of the electric motor extends through the carriage 11 parallel to its movement direction and is provided with respectively one miter wheel 24 25 allocated to each stitching unit 6, 7, to form a miter gear unit 28, 29 together with a miter wheel 26, 27. The driving miter wheel 26, 27 is respectively located on the shaft 30 of the friction wheel 17, as particularly shown in FIG. 3. The shaft 30, for example a spline shaft or polygonal shaft, has a form-fitting cross section to drive the miter wheels 24, 25. The shaft 30 is supported inside bearing blocks 31, 32 of the stitching aggregates 6, 7 fixedly connected to the stitching carriage 11, and the miter wheels 24, 25 are positioned on roller bearings in the bearing blocks 31, 32. The stitching carriage 11 has two side walls, and the shaft 30 extends with at least some play through the wall facing the electric motor 21. Alternatively, the bearing blocks 31, 32 can also be attached to the stitching carriage 11.

The wire feed supplies a wire segment to form a symmetrical staple 33, as shown in FIG. 5. The wire segment for the staple 33 is supplied to the bender 35 and the driver 36, which together form the stitching head 34. A wire-cutting device 38 is arranged upsteam of the stitching head 34 relative to the feed of the wire. The wire segment to be shaped into a staple 33 is positioned evenly spread out over the bender 35 such that a staple 33 with identically long legs 39 is formed. Owing to possible different sizes for the staple 33, the wire-cutting device 38 can be adapted to various staple sizes such that the wire section comes to rest evenly distributed relative to the bender. A movable gripper or clamp 40 on the stitching head 34 of the stitching aggregate 6, 7 holds the wire segment in place and positions the wire segment for bending. The wire cutting device 38 includes a blade holder 41 with wire lead-through 42 provided on its rear side with a blade 43 that is drive-connected to the pullback movement of the driver 36. The blade 43 cuts the wire section with the aid of the wire lead-through 42 acting as a counter blade.

Figure 4:
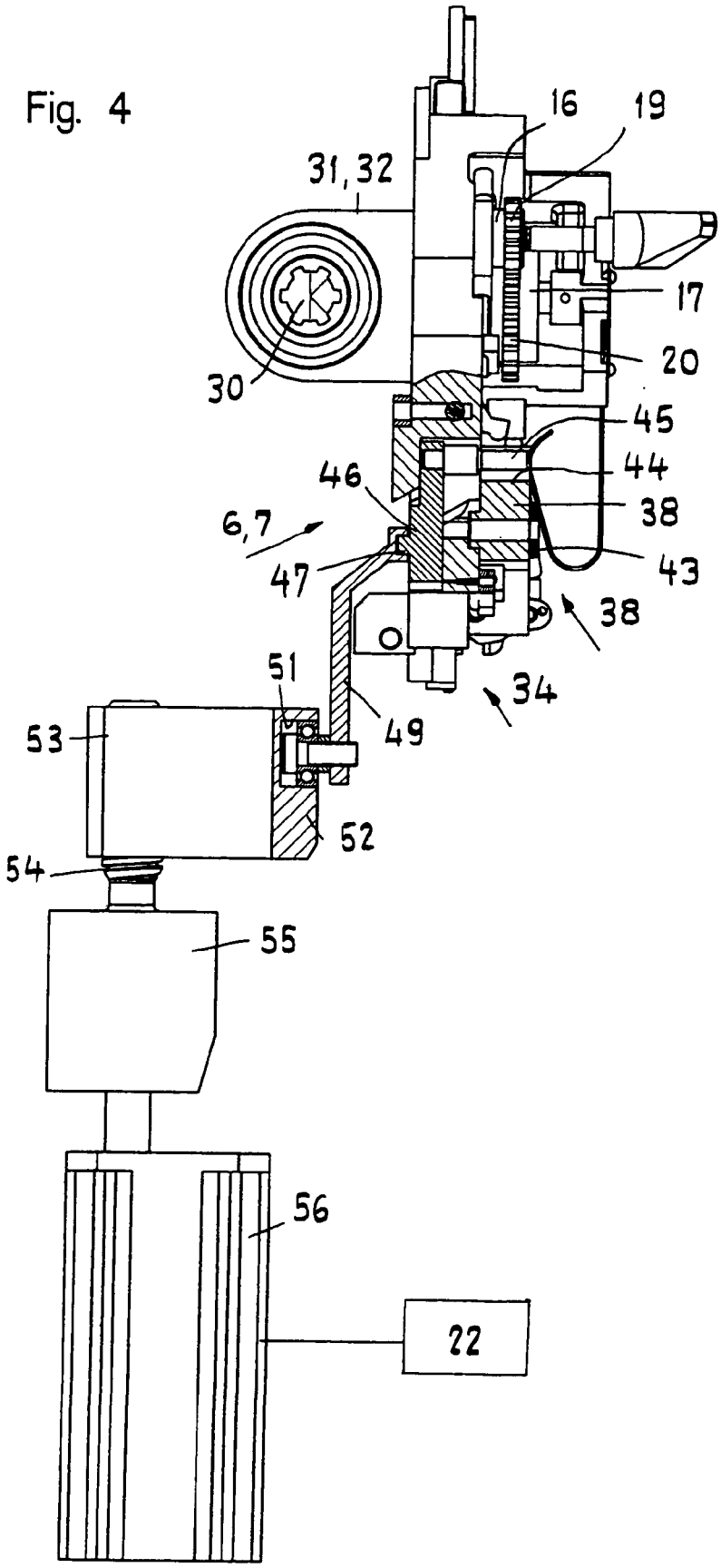
FIG. 4 shows a side view of a stitching aggregate for the stitching unit.
Figure 9:
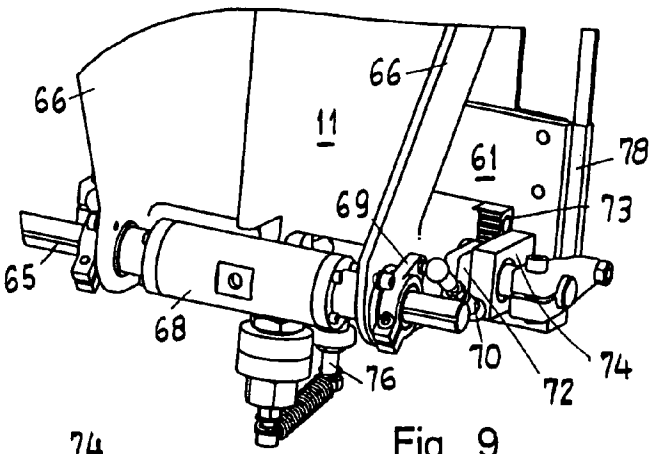
FIG. 9 shows a view of the drive unit for the bending device.

To ensure an evenly positioned wire segment for the stitching head 34, the blade holder 41 is displaced corresponding to the advancing and/or following wire end in such a way that the wire section, which is gripped by the gripper 40 following the cutting by the blade 43, assumes the stitching position in the stitching head. When cutting staples of different wire lengths, the blade holder 41 includes an upwardly slanted guide track 44 into which a follower pin 45, attached to a slider 46, engages. As particularly shown in FIGS. 4 and 7, the blade holder 41 is in the position for the shortest wire sections. The slider 46, in turn, is a plate and is guided on all sides. The slider 46 has a drive cam 47 on the rear side that engages a cam rail 48 which connects the sliders 46 of the blade holders 41. Arms 49 form the ends of the cam rail 48 and have freely rotating guide rollers 50 on the exposed ends which project into a slit-type guide member 51 on a guide rail 52. The guide rail 52 extends below the stitching aggregates 6, 7, and the length of guide member 51 equals at least the length of the path for stitching carriage 11. The guide rail 52 is attached at each end to respectively one support 53 having an inside thread for receiving a thread spindle 54. The thread spindles 54, which are provided for adjusting the height of guide rails 52, are positioned in a bearing block 55 attached to a machine frame 12 and are drive-connected to a locally fixed electric motor 56. Depending on the thickness of the printed products 5 to be stitched, the blade holders 41 of the stitching aggregates 6, 7 are adjusted and/or adapted 5 with the aid of the electric motors 56 and the control unit 22. The height of guide rail 52 is adjusted either before or after the stitching of a printed product without leading to a delay in machine timing. Reference numeral 5' in FIG. 1 refers to a stitched printed product which is subsequently removed from the support 3.

Figures 11, 12, 13:
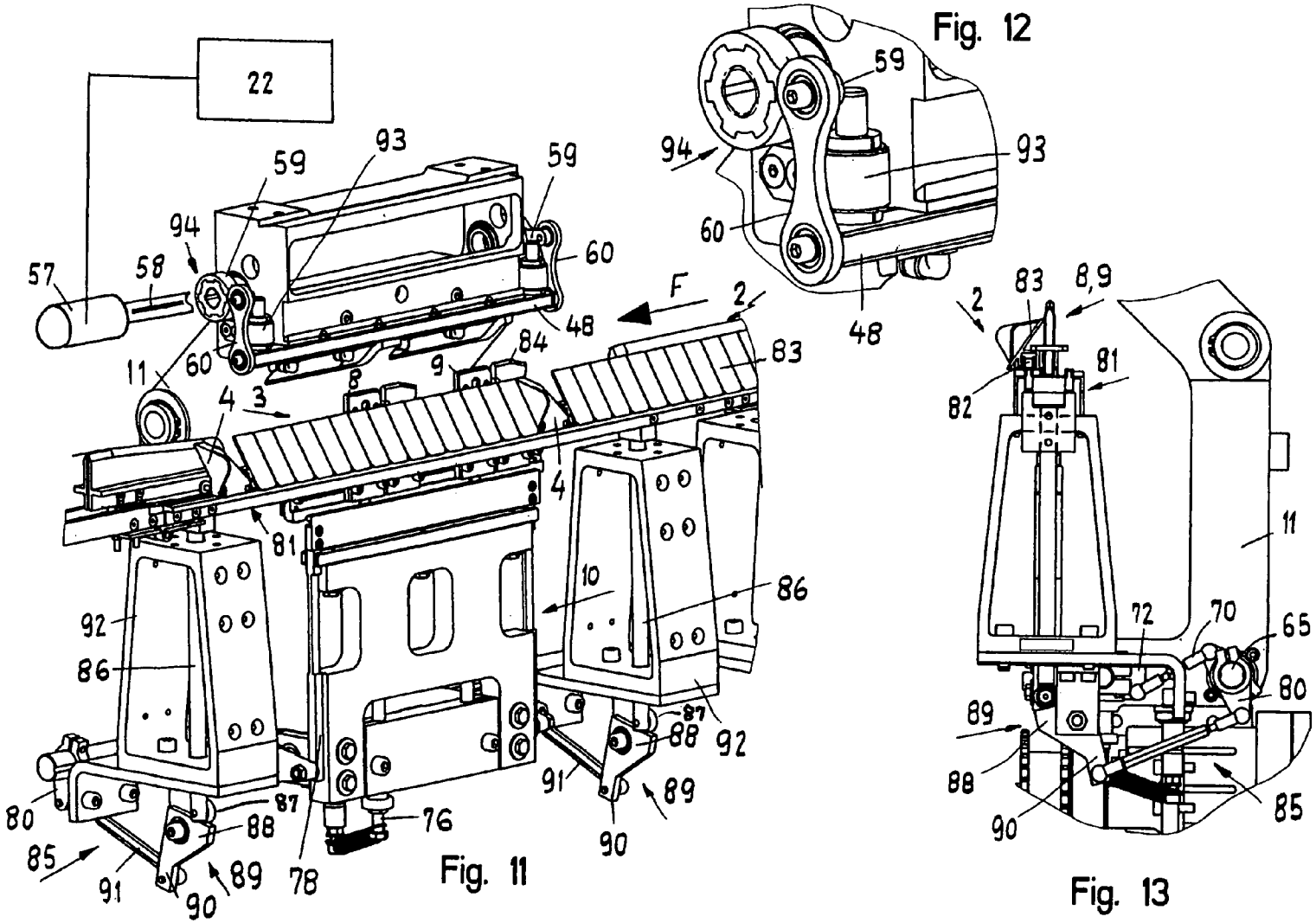
FIG. 11 shows an alternate embodiment of the wire stitching unit.
FIG. 12 shows an enlarged view of a detail showing the adjustment mechanism according to FIG. 11.
FIG. 13 shows a drive unit for adjusting the height of the conveying arrangement.

In an alternative design of the adjustment mechanism for the blade holder 41, the follower pin 45 that engages in an upwardly slanted guide track 44 is drive-connected via a lever arrangement 94 to a locally fixed electric motor 57 (see FIGS. 12 and 13). The drive shaft 58 of the lever arrangement 94, in turn, can have a form-fitting design and respectively one single-arm lever 59 can be secured thereon so as to be displaceable at the end of stitching carriage 11. A guide rod 60 is connected at one end to the single-arm lever 59 and to a cam rail 48 at the other end, as particularly shown in FIG. 11. The cam rail 48 is arranged to be height-adjustable inside a guide mechanism 93.

FIGS. 2, 8, 9 and 10 show the adjustment mechanism for the bending device 10 arranged on the carriage 11. The bending device 10 includes two bending blocks 8, 9, which can be jointly adjusted and height adapted according to different thicknesses of the printed products 5. The adjustment mechanism for the bending device 10 includes a bending support 61. The bending support 61 can be guided while positioned vertically on a wedge 62 attached to the stitching carriage 11 and is held on the carriage 11 with screws 63 that respectively extend through a vertical slot.

Figure 10:
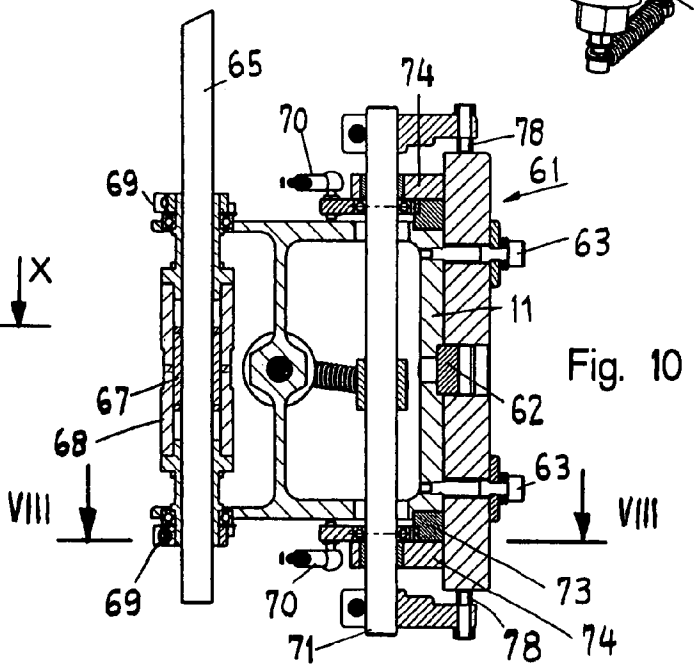
FIG. 10 shows a sectional view through the bending device along the line X—X of FIG. 8.
Figure 8:
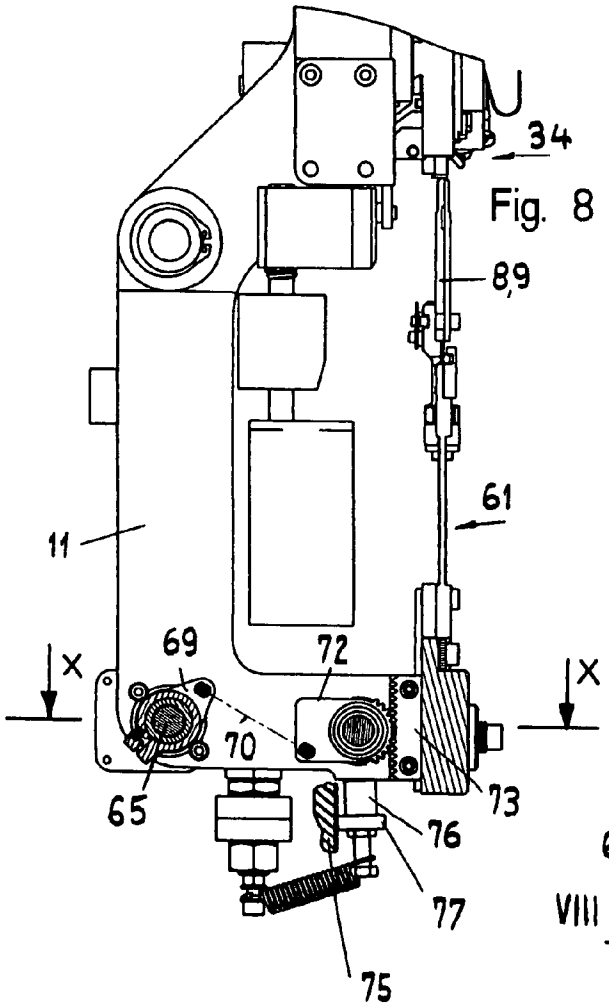
FIG. 8 shows a sectional view through the stitching carriage along the line VIII—VIII of FIG. 10.

As particularly shown in FIGS. 8 and 10, the height of bending blocks 8, 9 is adjusted with an torque-controlled electric motor 64 locally fixed to the machine frame 12. The electric motor 64 includes a drive shaft 65 having a width approximately corresponding to the width of the stitching carriage 11. The drive shaft 65 is positioned inside the stitching carriage 11 on two spaced-apart stiffening ribs 66. A torque-transferring ball sleeve 67 is positioned between the stiffening ribs 66 and is designed as a torque-transmitting and displaceable shaft-hub connection to transmit the rotational movement of the drive shaft 65 to a bushing 68 that is positioned on the drive shaft 65 and moving along with the stitching carriage 11. The bushing 68 and the drive shaft 65 are positioned jointly with ball bearings in the stiffening ribs 66. Respectively one clamping lever 69 is attached to the ends of the bushing 66. The clamping lever 69, which can be pivoted with the aid of the electric motor 64 and the drive shaft 65, is connected with a rod 70 to a toothed segment 72 positioned on a parallel shaft 71. The toothed segment 72 meshes with a gear rod 73 attached to the stitching carriage 11. As a result of the movements of drive shaft 65 and the shaft 71 connected via bearing blocks 74 to the bending support 61, the bending support 61 is lowered or raised to a desired level, which corresponds approximately to the difference in thickness between two printed products 5.

The wings on the head of the bending blocks 8, 9 which form the closed staple are operated with a control curve 75, along which a pivoting lever 76 positioned on a shaft 71, as a result of the stitching carriage movement, are pivoted counter to the spring force that activates tappets 78 guided on both sides of the carriage 11 with a control roller 77. The tappets 78 are connected via levers 79 to the shaft 71.

FIGS. 11 and 13 particularly illustrate that the conveying arrangement 2 can be adjusted in height with the bending device 10. An additional clamping lever 80 is provided on the shaft 65 on both sides of the stitching carriage 11. The conveying arrangement 2 includes a chain guide 81, across which two circulating link chains 82 are guided. Individual members 83 are fitted onto the chains 82 to form a roof-shaped support 3. FIGS. 11 and 13 show individual members 83 that are inclined only to one side. At the upper end of the support 3, the individual members 83 form a gap through which the bending blocks 8, 9 are lifted. In conveying direction F of the printed products 5, guide elements 84 that guide the printed products 5 onto the bending blocks 8, 9 are arranged in front of the bending blocks and are connected so as to be adjustable along with the bending blocks. The height of the conveying arrangement 2 is adjusted with a lever gear 85, which acts from below upon the chain guide 81. Two lifters 86 are connected at a distance to each other to the chain guide 81 and extend in a downward direction. The lifters 86 are positioned with a roller 87 on a first lever arm 88 of an angled double lever 89. The second lever arm 90, at an angle of approximately 90°, is connected at an exposed end via a guide rod 91 to the clamping lever 80. The lifters 86 are guided inside a frame 92 fixedly connected to the machine frame 12.

The invention has been described in detail with respect to preferred embodiments, and it is will now be apparent from the foregoing to those skilled in the art, that changes and modifications may be made without departed from the invention, therefore, as defined in the appended claims, is intended to cover all such changes and modifications that fall within the true spirit of the invention.

What is claimed is:

1. A wire-stitching apparatus for producing wire-stitched print items, comprising:

a conveying arrangement for supplying folded, printed products in a straddling position;

a wire-stitching unit installed at an adjustable distance above the conveying arrangement and including a bending device, at least one wire-stitching aggregate, and a stitching carriage for moving the at least one wire-stitching aggregate back and forth along a path, wherein the at least one wire-stitching aggregate includes a bender for forming a wire segment into a staple with legs and a driver for pushing the staple legs through the printed products;

at least one wire feed for feeding wire for the staple to the at least one wire-stitching aggregate at a stitching wire length;

at least one adjustable wire-cutting device for adapting the stitching wire length of the staple to the thickness of the printed products;

a control unit for performing one of the following functions 1) measuring the thickness of the printed products positioned on the conveying arrangement upstream of the wire-stitching unit, and 2) processing stored data related to the printed products;

means for adjusting the wire-cutting device coupled to the control unit;

means for adjusting the wire-stitching unit, including at least one locally fixed means for driving the adjustment of the wire-stitching unit connected to the control unit; and means for adjusting the height of the conveying arrangement, including controllable, locally fixed means for driving.

2. The wire-stitching apparatus according to claim 1, wherein the wire feed is adjustable according to the thickness of the printed products, and wherein the apparatus further comprises means for adjusting the wire feed that includes a drive shaft extending through the stitching carriage parallel to the path of the stitching carriage and at least one drive wheel displaceably mounted on a drive shaft.

3. The wire-stitching apparatus according to claim 2, wherein the wire feed includes two friction wheels and a wheel arrangement driving the friction wheels to transport the wire.

4. The wire-stitching apparatus according to claims 2, wherein the gear is a miter gear.

5. The wire-stitching apparatus according to claim 1, wherein the wire-cutting device includes a blade holder that can be adjusted to the thickness of printed products, the wire-cutting device adjusting means including a follower pin arranged on the blade holder, a guide track engaging the follower pin and extending at a slant relative to the path of the stitching carriage, a height-adjustable guide rail coupled to the follower pin, and at least one torque-controlled electric motor coupled to the height-adjustable guide rail.

6. The wire-stitching apparatus according to claim 5, wherein the guide rail includes a guide member, and wherein the wire-cutting device adjusting means includes drive cams arranged on the blade holders and a cam rail attached to the stitching carriage and acting upon drive cams of the blade holders of the at least one stitching aggregate such that the cam rail can be driven back and forth inside the guide member of the guide rail.

7. The wire-stitching apparatus according to claim 1, wherein the wire-cutting device includes a blade holder that can be adjusted to the thickness of the printed products, the wire-cutting device adjusting means including a follower pin on the blade holder that engages in a guide track extending at a slant to the path of the stitching carriage, means for driving the guide tracks, and a lever arrangement connecting the guide track to the guide tracks driving means.

8. The wire-stitching apparatus according to claim 7, wherein the guide track driving means includes an electric motor, a shaft extending through the stitching carriage parallel to the path and connected to the electric motor, at least one lever connected to the shaft, a guide rod connected to the at least one lever, and a cam rail actuated by the guide rod.

9. The wire-stitching apparatus according to claim 1, further comprising a bending device that can be adjusted to the thickness of the printed products, the bending device having at least one bending block and an adjustable bending support supporting the at least one bending block, and wherein the apparatus further comprises means for adjusting the bending support that includes a gear, a drive shaft attached to the gear, and a locally fixed, torque-controlled electric motor for driving the drive shaft.

10. The wire-stitching apparatus according to claim 9, wherein the bending support adjusting means includes a toothed segment drive-connected to the bending support, a stationary toothed rack that can be moved along with the toothed segment, and a lever arm arranged on the drive shaft of the electric motor and connected to the toothed segment.

11. The wire-stitching apparatus according to claim 10, wherein the bending support adjusting means includes a shaft-hub connection for connecting the drive shaft to the lever arm, the shaft-hub extending through the stitching carriage along the path of the stitching carriage for transmitting torque when being displaced by the drive shaft.

12. The wire-stitching apparatus according to claim 9, wherein the torque of the electric motor can be preset for operation.

13. The wire-stitching apparatus according to claim 1, wherein the conveying arrangement is adjustable to the thickness of the printed products and includes a chain guide, at least one link chain circulating on the chain guide with downwardly extending lifters, and a roof-shaped support with individual members attached to the chain guide, wherein the apparatus further comprises means for adjusting the conveying arrangement that includes lever gears attached to a drive shaft.

* * * * *